US006834597B2

(12) United States Patent
Northcutt

(10) Patent No.: US 6,834,597 B2
(45) Date of Patent: Dec. 28, 2004

(54) SMALL CALIBER MUNITIONS DETONATION FURNACE AND PROCESS OF USING IT

(76) Inventor: Terry Northcutt, 29925 Highway 108, Cold Springs, CA (US) 95335

( * ) Notice: Subject to any disclaimer, the term of this patent is extended or adjusted under 35 U.S.C. 154(b) by 165 days.

(21) Appl. No.: 09/953,655

(22) Filed: Sep. 10, 2001

(65) Prior Publication Data

US 2003/0050524 A1 Mar. 13, 2003

(51) Int. Cl.[7] ..... F23G 7/00; F27D 3/00
(52) U.S. Cl. ..... 110/237; 110/255; 432/241
(58) Field of Search ..... 110/173 B, 237–227, 110/228, 242, 255; 588/202; 432/241; 422/189; 86/50

(56) References Cited

U.S. PATENT DOCUMENTS 3,772,958 A * 11/1973 Mullarkey ..... 86/1 R
3,793,101 A * 2/1974 Mullarkey ..... 149/109
4,625,661 A 12/1986 Melchior
4,934,283 A 6/1990 Kydd
5,207,176 A 5/1993 Morhard et al.
5,423,271 A 6/1995 Schulze
5,434,336 A 7/1995 Adams et al.
5,495,812 A * 3/1996 Schulze ..... 110/237
5,522,326 A 6/1996 Vollhardt
5,582,119 A 12/1996 Barkdoll
5,613,453 A 3/1997 Donovan
5,649,324 A 7/1997 Fairweather et al.
5,660,123 A 8/1997 Tadmor et al.
5,668,342 A * 9/1997 Discher ..... 86/50
5,714,707 A 2/1998 Ruia
5,727,481 A 3/1998 Voorhees et al.
5,741,465 A * 4/1998 Gregg ..... 422/189
5,881,654 A 3/1999 Fleming et al.
5,884,569 A 3/1999 Donovan
5,907,818 A 5/1999 Hebisch et al.
6,173,662 B1 1/2001 Donovan
6,245,958 B1 * 6/2001 Morse et al. ..... 588/202
6,257,157 B1 * 7/2001 Havens et al. ..... 110/235

* cited by examiner

*Primary Examiner*—K. B. Rinehart
(74) *Attorney, Agent, or Firm*—Morrison & Foerster LLP

(57) ABSTRACT

This relates to a furnace that is useful in safely detonating or demilitarizing munitions or explosives, particularly small caliber munitions. The preferred variation includes a series of chambers having a set of runners or tracks passing amongst the various chambers to allow movement of the munitions from chamber to chamber in trays. The first chamber is heated in such a way so that a tray of munitions placed on the runners in this chamber are baked and detonated. After the detonation is generally complete, the tray containing the then-detonated munition fragments is slid through an opening at the end of that heated detonation chamber into a first cooling chamber. Generally, this movement takes place by addition of another tray containing non-detonated munitions into the first chamber. The furnace may also contain a second cooling chamber to assure both that the subject munitions are detonated and to allow then-safe exiting of the completely detonated munitions from the second cooling chamber onto an external extension of the track. The furnace is configured so that the munitions, whether detonated or not, remain in trays which may be slid through an operating unit without substantial hazard. Also included is a scrubber for removing noxious or deleterious components of gases produced by the detonation before it is passed into the atmosphere. Finally, this includes a method of using a chambered furnace to detonate small arms munitions or other explosives.

21 Claims, 6 Drawing Sheets

SMALL CALIBER MUNITIONS DETONATION FURNACE AND PROCESS OF USING IT

FIELD OF THE INVENTION

This invention relates to a furnace that is useful in safely detonating or demilitarizing munitions or explosives, particularly small caliber munitions. The preferred variation of the invention includes a series of chambers having a set of runners or tracks passing amongst the various chambers to allow movement of the munitions from chamber to chamber in trays. The first chamber is heated in such a way so that a tray of munitions placed on the runners in this chamber are baked and detonated. After the detonation is generally complete, the tray containing the then-detonated munition fragments is slid through an opening at the end of that heated detonation chamber into a first cooling chamber. Generally, this movement takes place by addition of another tray containing non-detonated munitions into the first chamber. The furnace may also contain a second cooling chamber to assure both that the subject munitions are detonated and to allow then-safe exiting of the completely detonated munitions from the second cooling chamber onto an external extension of the track. The furnace is configured so that the munitions, whether detonated or not, remain in trays which may be slid through an operating unit without substantial hazard. The invention preferably includes a scrubber for removing noxious or deleterious components of gases produced by the detonation before it is passed into the atmosphere. Finally, the invention includes a method of using a chambered furnace to detonate small arms munitions or other explosives in the manner outlined above.

BACKGROUND OF THE INVENTION

Sportsmen and the armed services buy and store ammunition prior to its eventual use. However, the shelf life of ammunition is not particularly lengthy. Additionally, if the ammunition if improperly stored, perhaps in the presence of excess or widely varying heat or moisture or pressure, the chemical compounds used in propelling the munition payload may become unstable or inert. After some period of time, the ammunition is simply considered unfit for use. At some military installations, old ammunition was simply buried in a landfill with the understanding that landfills would not be disturbed. However, due to the demilitarization of many military installations and the potential for contamination of ground water, ammunition disposed of in such way has become a liability to be dealt with.

Demilitarization of munitions that have been buried or are simply past useful date by incineration in an open pit was practiced for many years. However, with the imposition of clean air regulations over the past several years, such open air incineration is no longer a viable alternative for disposal of ammunition.

There are a variety of ways to deal with material such as this. Many of the procedures and devices already known are specific in their intent to recycle, e.g., cartridge cases for reloading. One such procedure is shown in U.S. Pat. No. 5,434,336, to Adams, et al. Adams shows a method for stabilizing "energetics," including explosives, propellance, pyrotechnics, and obsolete munitions via process of reaction or liquid sulfur. The reaction products are suitably non-explosive and safe.

Another process for chemically demilitarizing a small caliber cartridge is with the intent that the cartridge cases be reused, is found in U.S. Pat. No. 5,714,707, to Ruia. The various cases are flushed with a chemical solution such as sulfuric acid to dissolve a bonding material holding the components of the explosive primer mix together. After dissolution of that binder, the primer mix breaks apart and flows into the case. After removal of the explosive primer, the deprimed cases are rinsed and used for reloading or in scrap recovery. The sulfuric acid is said both to desensitize the primer composition without inducing significant stress cracking in the cases.

There are a variety of incinerator-based methods and devices useful in demilitarizing ammunition. These procedures generally are not used with the intent of reusing the cartridges, but instead, produce only reclaimable metals.

U.S. Pat. No. 5,207,176, to Morhard, et al., describes a process for treating such materials using a rotary kiln having a helical flight within. Similarly, U.S. Pat. No. 5,522,326, to Vollhardt, also shows a rotary kiln used variously on ammunition or on material containing chemical warfare agents.

U.S. Pat. No. 5,582,119, to Barkdoll, shows a vessel containing a hot granular bed of material (such as sand) to ignite explosive waste and to dampen any forces generated by the ignition of that waste.

U.S. Pat. No. 5,423,271, to Schulze, shows a process for use of incineration trays for the decomposition of various explosives. The trays are passed through a furnace as a part of a conveyor-like train.

U.S. Pat. Nos. 5,613,453; 5,884,569, and 6,173,662 all to Donovan, show an explosion chamber made up of a double walled, steel structure anchored to a concrete foundation. The explosive chamber has double walled access doors for charging materials to be destroyed. The floor of the chamber is covered with granular shock damping bed such as pea gravel.

U.S. Pat. No. 5,649,324, to Fairweather, et al., discusses a general use of an incineration reactor to deflagrate explosives. "Deflagration" is generally the non-explosive reaction of explosive material. The Fairweather, et al. patent describes methods for recovery of heat and removal of difficult gases from reaction products.

U.S. Pat. No. 5,660,123, to Tadmore, shows a procedure for batchwise destruction of various kinds of explosive materials by adding them to a combustion furnace holding a burning coal bed.

U.S. Pat. No. 5,727,481, to Voorhees, et al., describes a mobile armored incinerator suitable for burning explosive materials. The device has armored walls capable of withstanding internal explosions. It is made up of a variety of sections, a primary chamber for incineration, a secondary combustion chamber to burn exhaust from the primary chamber, and a trailer for providing transportation.

U.S. Pat. No. 5,881,654, to Fleming, et al., shows a device for pyrolizing explosives using a multizoned chamber having a remote combustion zone and an attached device for separating the various products of the combustion.

U.S. Pat. No. 5,907,818, to Hebisch, et al., shows a method of using a rotary cylindrical furnace and separating the resulting reaction products.

None of the devices or procedures shown in any of the documents discussed above are similar to the furnace and procedure for its use shown below.

SUMMARY OF THE INVENTION

This invention deals with a furnace for controllably detonating explosive materials, preferably small arms munitions, but also explosives, fireworks, and the like. The furnace itself preferably has several chambers. The first chamber is a heated detonation chamber defined by containment walls. At least a portion of the containment walls are resistant to detonation of the small caliber munitions, e.g., both the flying shrapnel and the percussive forces. The walls internal to the furnace need not be so resistant, but desirably are. The heated detonation chamber preferably has a first opening which is sealable or closable. This opening is for introducing undetonated small caliber munitions to the heated detonation chamber, preferably on a tray. The first or heated detonation chamber has a second opening in a separator wall for removing the detonated munitions from the heated chamber. The second opening preferably is also closable but need not be. The furnace has at least one movable covering for closing the first sealable opening into the heated detonation chamber. The furnace also includes a set of tray runners or tracks that extend generally from the first sealable opening to the second sealable opening and are adapted to slidably support trays containing the detonated or undetonated munitions from the first sealable opening through the second opening. They tray runners or tracks preferably then pass through the optional cooling chambers adjacent the detonation chamber. The furnace is adapted in such a way that introduction of the tray through the first sealable opening into the heated detonation chamber pushes a tray already in the detonation chamber into the first cooling chamber. This action pushes a tray in the first cooling chamber into a second cooling chamber and, in turn, pushes a tray from the second cooling chamber through an exit opening at the exit end of the furnace for access by a furnace operator. The walls of the first and second cooling chambers may be containment walls that are resistant to detonation of the small caliber munitions. The wall between the second cooling chamber and the first cooling chamber may be a partial wall or baffle. Preferably, the heated detonation chamber includes a funneling baffle that extends the length of the chamber and directs detonated munitions fragments flying about within the chamber back to the tray residing on the tray runner or tray track.

The furnace preferably includes a burner situated so that the small arms munitions residing in a tray in the heated detonation chamber are indirectly heated through the tray or are "baked." The burner preferably is hydrocarbon fired, e.g., by a gas such as methane, propane, or butane. The device may, of course, also use liquid fuels such as kerosene or gasoline.

The inventive furnace preferably includes a scrubber to remove deleterious gases such as sulfur dioxide or trioxide or nitrogen oxides. The scrubber preferably sits adjacent a gas outlet above the heated detonation zone and is protected by an internal baffle.

The invention includes a method of controllably detonating small caliber munitions made up of the steps of: providing a heated detonation chamber having a first opening for introducing undetonated small caliber munitions to the heated detonation chamber and a second opening in a separator wall for removing then-detonated small caliber munitions from the heated detonation chamber. The heated detonation chamber preferably has tray tracks or runners extending between the first sealable opening and the second opening and those tray runners are adapted to slidably support a tray passing through the first sealable opening, through the heated detonation chamber, and through the second opening. The tray tracks or runners are adapted to support the tray during heated detonation of the small caliber munitions. The method further includes the steps of providing some amount of small caliber munitions in a first tray to that heated detonation chamber in a first tray, detonating the small caliber munitions to produce detonated small caliber munitions, and then withdrawing the detonated small caliber munitions and the first tray from the heated detonation chamber. The procedure may include the further steps of introducing a second tray into the heated detonation chamber and pushing the first tray along the tray runners into the first cooling chamber. The process optionally further includes the step of introducing a third tray containing small caliber munitions into the heated detonation chamber and pushing the first tray into a second cooling chamber and pushing the second tray into a first cooling chamber along the tray runners. The process may include another step of introducing a fourth tray into the heated detonation chamber and pushing variously the first tray from an exit in the second cooling chamber, the second tray into the second cooling chamber, and the third tray into the first cooling chamber along the tray tracks. The process generally includes the ancillary steps of moving a covering that is resistant to detonation of the small caliber munitions to close the first sealable opening after introduction of the first tray containing small caliber munitions into the heated detonation chamber. Also included are the steps of detonating the small caliber munitions by heating the heated detonation chamber and scrubbing deleterious gaseous components produced in the detonation step using a scrubber that is in communication with the heated detonation chamber.

DESCRIPTION OF THE INVENTION

This invention is a furnace for controllably detonating typically small amounts of materials that are explosive. Such materials include small caliber munitions, fireworks, and other similar materials. It is especially useful for demilitarization of small caliber munitions in a way that the component materials, e.g., brass and lead, may be easily recycled. The furnace preferably is made of fairly sturdy material on its various external surfaces generally to withstand the forces of detonated munitions that may be flying around inside the device. For detonation of munitions that are 50 caliber or below, one-half inch thick mild steel is usually quite suitable. The furnace may be easily fabricated in a size that is suitable for reasonable portability. That is to say that a desirable size would be, for instance, a three foot diameter furnace body with the ancillary supports, burners, fuel sources, and the like sized to fit.

Figure 1:
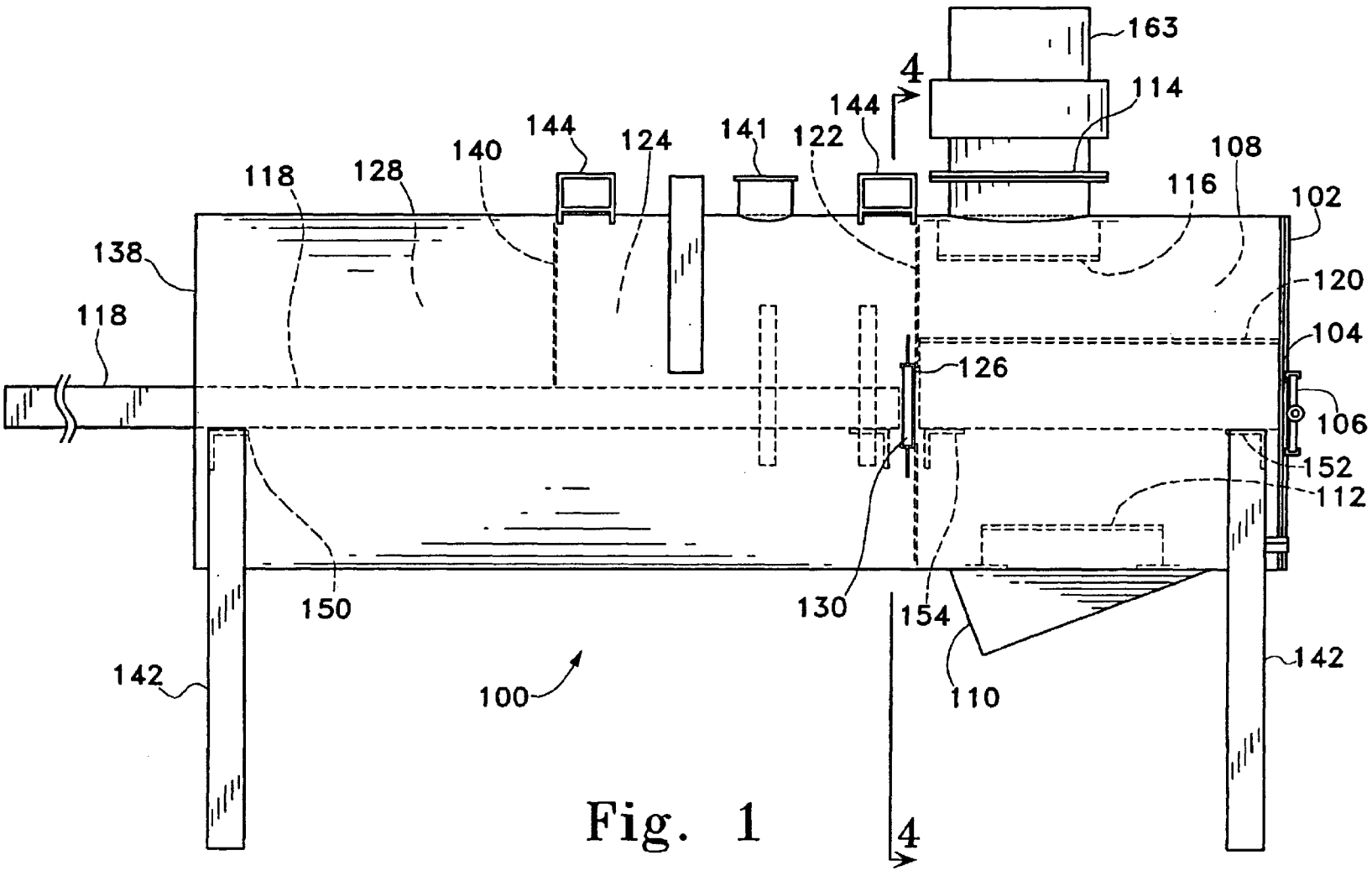
FIG. 1 shows a side view of the inventive furnace depicting internal components of the device using dotted lines.
Figure 1A:
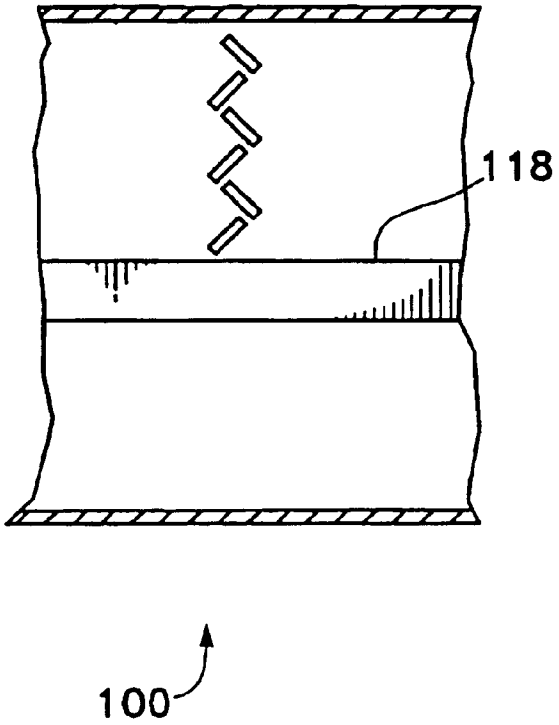
FIG. 1A shows a side view, cross section of the inventive furnace with a baffle wall.
Figure 3B:
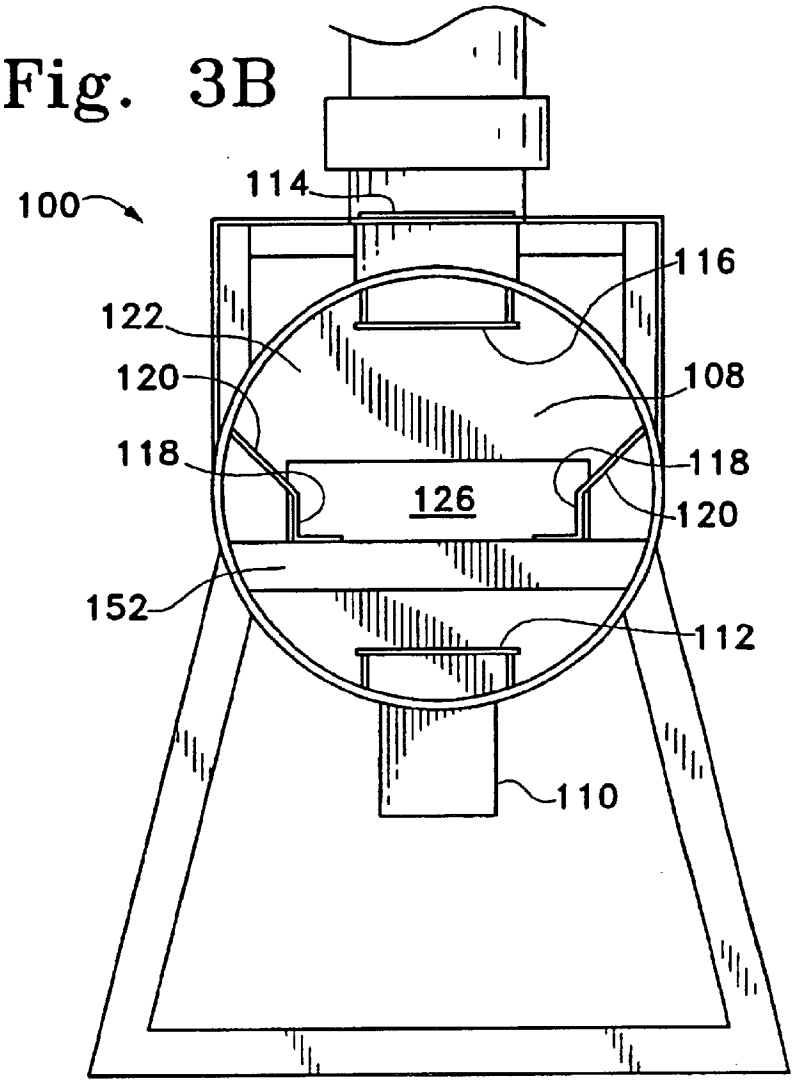
FIG. 3*b* shows an end view of the device with the entrance head removed.
Figure 3A:
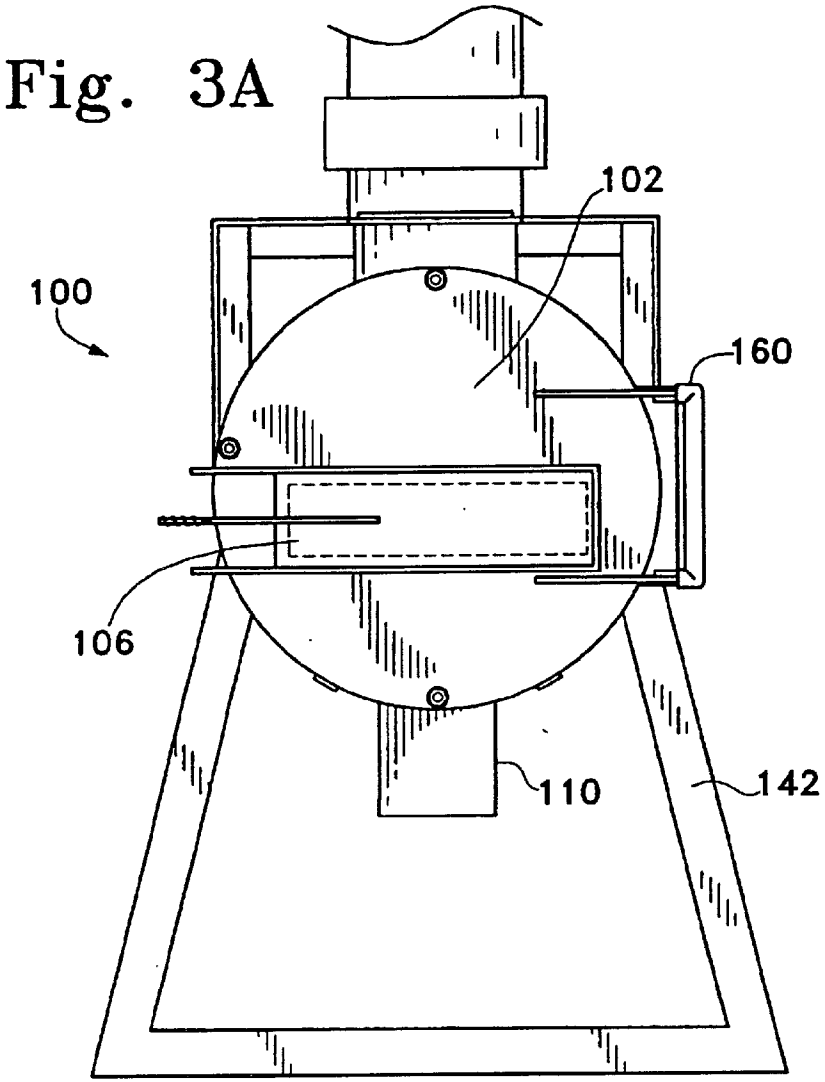
FIG. 3*a* shows an entrance end of view in the inventive device with the closure head installed.

FIG. 1 shows a side view of the inventive furnace (100). The furnace has an entrance end (102) that will be discussed in additional detail relating to FIGS. 3*a* and 3*b*. The entrance end (102) has a first sealable opening (104) that may be closed by at least one movable covering (106). The variation shown in FIG. 1 and in FIG. 3*a* shows the movable covering to be a simple sliding door. Of course, in other situations, a pair of sliding doors or a hinged door having a catch to prevent it from opening during furnace operation would also be excellent choices. Sealable opening (104) opens into a heated detonation chamber (108). This detonation chamber (108) is heated in this variation of the invention by hot gases typically passed into chamber (108) through one or more burner ports (110). Typically, the heat source will be placed in the furnace so that it indirectly heats the munitions to be detonated, although this is not a requirement of the invention. Also shown in FIG. 1 is a baffle (112) that is situated to prevent fragmented munitions from flying into the burner. As may be seen more clearly in FIG. 3*b,* the heated detonation chamber (108) is surrounded in such a way that burner baffle (112) normally would not see fragmented munitions. Also seen both in FIG. 1 and in FIG. 3*b* is an opening (114) for passage of any gaseous products produced as a result of the thermal detonation taking place in chamber (108). Many explosives contain complex chemical compounds of nitrogen and/or sulfur. Reaction of these materials during the detonation typically would produce sulfur oxides ($SO_2$ and $SO_3$). Various nitrogen oxides would also likely be a product. Carbon dust, metal dust, and perhaps lead compounds or particulates might also be found in the exhaust leaving through outlet (114). Again, a baffle (116) is used to prevent passage of fragmentation products produced as a result of detonation from passing into any scrubber connected to outlet passageway (114).

Figure 6:
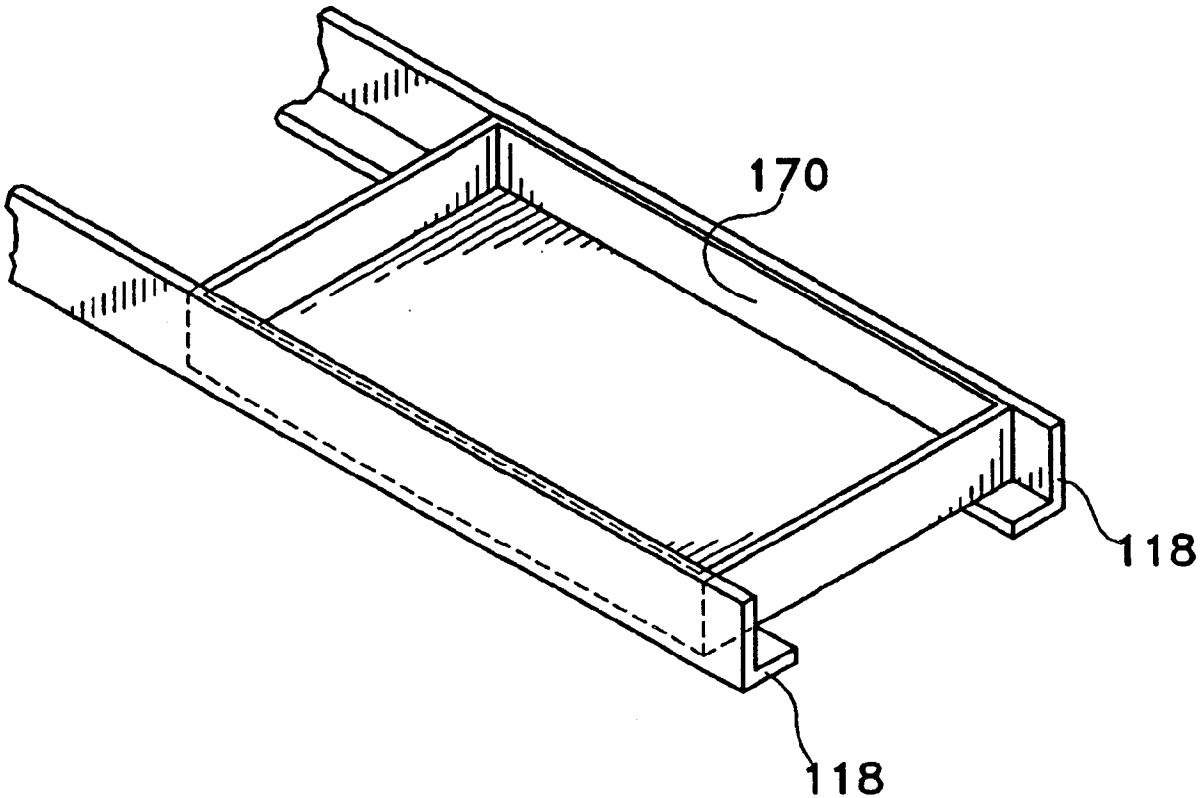
FIG. 6 shows a perspective view of a tray useful in the inventive furnace.

Shown in FIG. 3*b* are a pair of tray rails or runners that are adapted to accept a tray of munitions introduced through sealable opening (104) once door (106) opened. FIG. 6 shows a typical tray in greater detail. Also shown in FIG. 3*b* are a pair of funneling baffles (120) that typically extend longitudinally through the heated detonation chamber (108) preferably from the entry end (102) to the separator wall (122) that marks the beginning of the first cooling chamber (124). These funneling baffles (120) have the function of returning those bits of flying munitions back into the tray that typically is found in chamber (108) and on tray rails (118) during a detonation sequence.

Returning to FIG. 1, as noted just above, the first cooling chamber (124) preferably shares a wall (122) with heated detonation chamber (108). In this separator wall (122) may be found a second opening (126) that both marks the pathway for a tray to pass from the heated detonation chamber (108) into the first cooling chamber (124). The various tray rails or runners (118) are aligned in the first cooling zone and in the optional second cooling zone (128) to allow movement of the trays along runners (118) simply by pushing a new tray into the heated detonation chamber (108).

Optional, but desirable, is the use of a door (130) to close second opening (126). A side view of suitable sliding door is found in FIG. 5.

Figure 5:
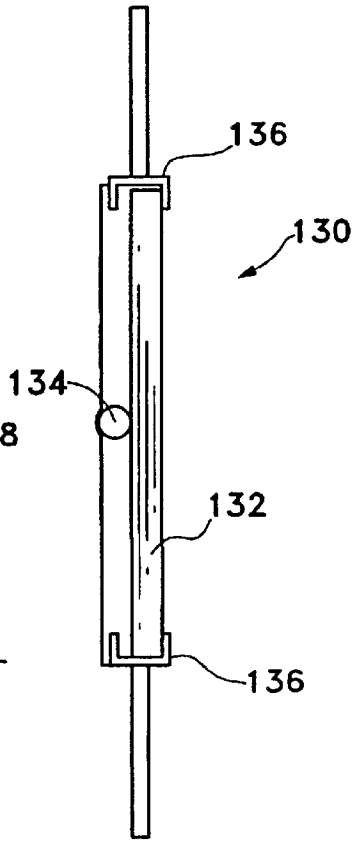
FIG. 5 shows a cross-section of a slide door used at the exit of the detonation zone.

Moving to FIG. 5, sliding door (130) may be made up of a solid door component (132), a handle (134) for manually moving the door, and a pair of tracks (136) to maintain alignment of door (132) during its transition in and out of the region between the heated detonation chamber (108) and first cooling chamber (124).

Returning to FIG. 1, tray runners (118) desirably continue from adjacent door assembly (130) through first cooling zone (124), through second cooling zone (128) and exit through exit head (138). The tray runners (118) may be seen extending from the exit head (138) of the furnace (100). A wall (140) desirably is placed between first cooling zone (124) and second cooling zone (128). It may be a partial wall or a baffle. The function of first cooling zone (124) is generally to allow a first stage of cooling of the detonated munitions and , in the event that any undetonated munitions remain in the tray, provides an opportunity of those to detonate in safety. An optional gaseous products outlet (141) is shown.

The second cooling chamber (128) exists for the purpose of allowing further cooling before exit of detonated munitions from the device through exit head (138) and allows drawing of remaining noxious material from the trays for treatment in the scrubber discussed above.

Other useful ancillary components of the device, e.g., legs (142) and lifting sites (144) have not been discussed at length but would certainly be the type of accompanying components easily designed by an equipment designer using the disclosure provided herein. Various supports for the tray runners, e.g., (150) as shown in FIG. 2 and (152) as shown in FIG. 1 and FIG. 3*b* and (154) as shown in FIG. 1 fall into this category.

Figure 2:
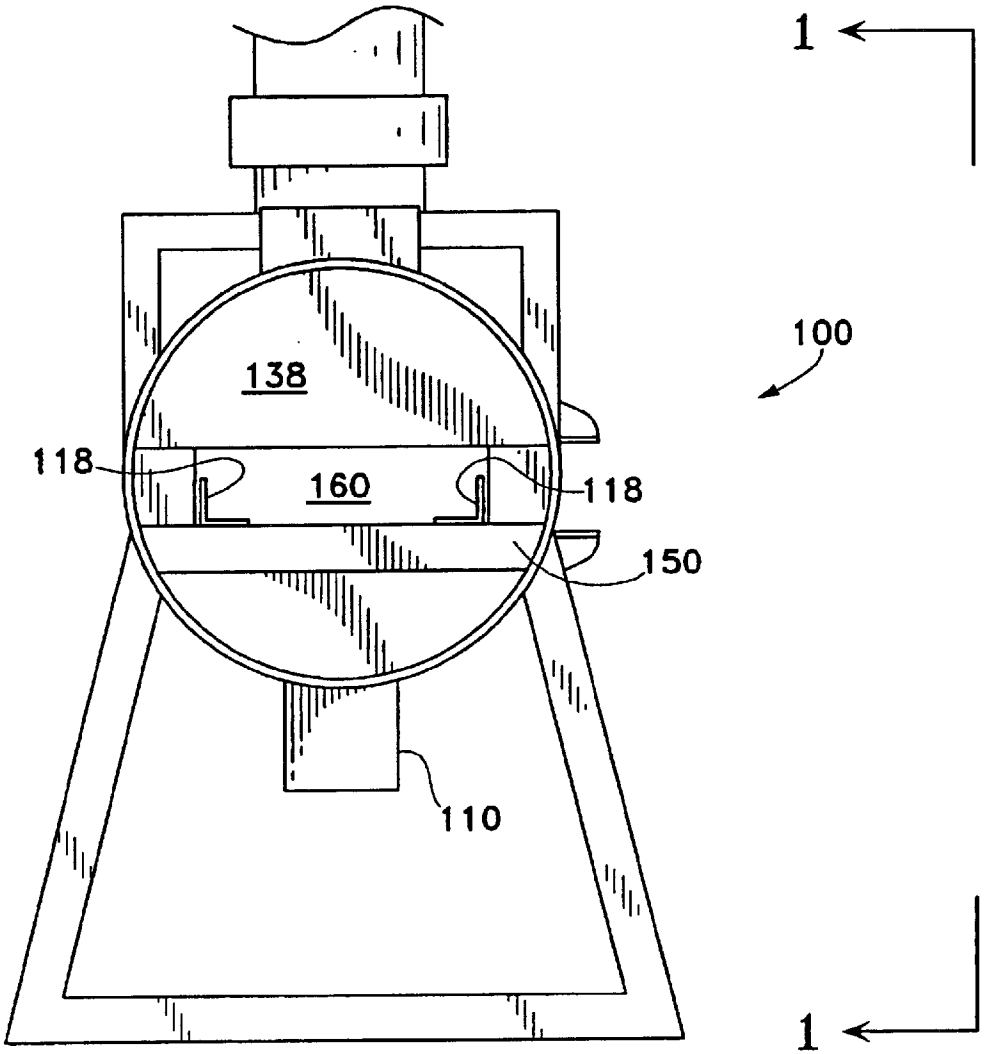
FIG. 2 shows an exit end view of the inventive device.

FIG. 2 shows the exit head (138) of the inventive furnace (100). The extended rails or tray runners (118) may be seen extending through an opening (160) found in that exit head (138).

FIG. 3*a* showing entrance head cover (102) as bolted in place on the inventive furnace (100) also shows a convenient hinge (160) for swinging entrance head (102) out of the way once it has been bolted for cleaning or repair of internals. The desired sliding door (106) covering the first sealable opening is also depicted.

Figure 4A:
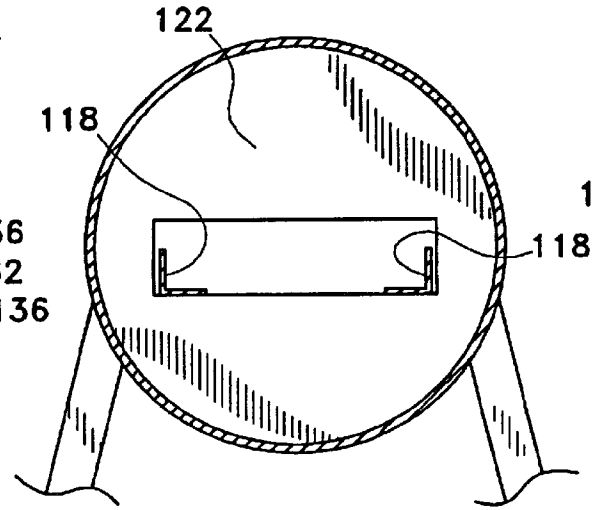
FIG. 4A shows a cross section of the furnace.
Figure 4:
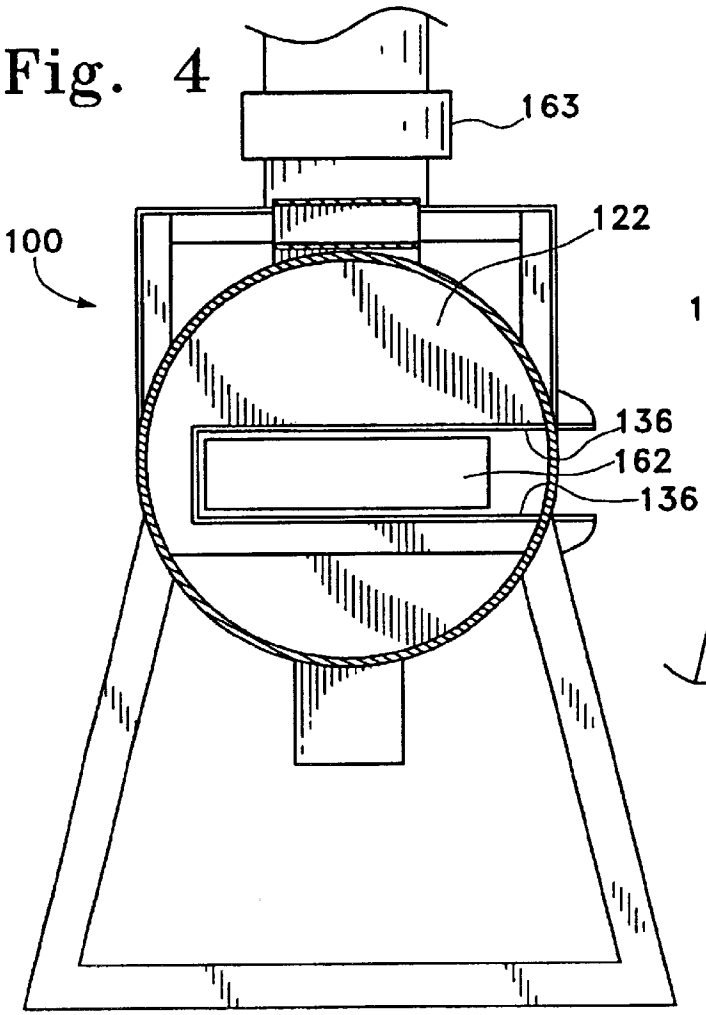
FIG. 4 is a cross-sectional view of the device at the exit of the detonation zone.

FIG. 4 shows a cross-sectional view of furnace (100) on the section line shown in FIG. 1. Separator wall (122) having second opening (162) therein is easily seen. It should be apparent that two variations of the tray runners are supports (118) are readily available. The tray runners may continuous through the length of furnace (100) or may be discontinuous at the separator wall (122) if the design of the specific device requires a sealing door such as (132) to pass through the region where the rails would otherwise reside. Said another way: the runners may extend from the entrance and pass the various internal operating chambers and extend out into the region exterior to the furnace (100) or the runners (118) may be segmented in a way that merely allows passage of the tray through the device without necessarily being single integrated component.

FIG. 4 additionally shows a schematic of a gas scrubber (163) in connection with outlets (122).

Finally, FIG. 6 shows a tray (170) that is typical of the type that might be used in the inventive furnace. Although a closed tray (170) is shown, the tray may have a lid or may have perforations through its side or bottom as desires. As shown in shadow in FIG. 6 are runners (118) to permit clear envisioning of the positioning of the tray on those tray runners (118).

The process of detonating small caliber munitions or other explosives is typically this. The tray (170) is loaded with a suitable amount of munitions for detonation. The tray, a first tray, is then slid through the first sealable opening into a heated detonation zone and the sealable opening is then closed. The heat may then be intermittently applied to the heated detonation zone. As an alternative, the heat may be continuously applied to the zone, although the safety of doing so is lessened during introduction of a new tray of munitions.

Once the detonation has been substantially completed, a second tray of munitions is slid into the heated detonation zone, pushing the first tray into the first cooling chamber. If desired, both doors to the first sealable entrance and the passageway in the separator wall may then be closed. The detonation step is then practiced by an application of heat to the heated detonation chamber.

This sequence is repeated using third and fourth trays as desired. The specific variation of the inventive furnace (100) shown in the drawings will hold four trays: a tray in the heated detonation chamber, a tray in the first cooling chamber, a tray in the second cooling chamber, and one on the extension of the tray runners extending beyond the exit head.

This invention has been described above using examples and the like. However, it is not intended that use of such examples in any way limits the invention in any way. It is my intent to rely upon the inventions as found below and in their equivalents.

I claim:

1. An apparatus for controllably detonating small caliber munitions, comprising a.) a heated detonation chamber defined by containment walls, at least a portion of which containment walls are resistant to detonation of the small caliber munitions, a first sealable opening for introducing undetonated small caliber munitions to the heated detonation chamber and a second opening in a separator wall for removing detonated small caliber munitions from the heated detonation chamber, b.) at least one movable covering for the first sealable opening, said at least one movable covering being resistant to detonation of the small caliber munitions, c.) tray runners extending between the first sealable opening and the second opening and adapted to slidably support a tray passing through the first sealable opening, through the heated detonation chamber, and through the second opening, and adapted to support the small caliber munitions during a heated detonation of the small caliber munitions in the heated detonation chamber, d.) at least one tray, adapted for supporting the small caliber munitions during a heated detonation of the small caliber munitions and slideable along the tray runners through the first sealable opening and through the second opening, and e.). a heat source for providing heat to the tray in the heated detonation chamber adapted to indirectly heat the small caliber munitions.

2. The apparatus of claim 1 wherein the second opening is sealable and comprising a movable covering closing at least a part of the second opening.

3. The apparatus of claim 1 wherein the movable covering for the first sealable opening is a slidable door.

4. The apparatus of claim 1 further comprising a funneling baffle adapted to return detonated munitions to the tray.

5. The apparatus of claim 2 wherein the movable covering for the second opening is a slidable door.

6. The apparatus of claim 1 further comprising a first cooling chamber defined by containment walls and the first interior wall at least a portion of which are resistant to detonation of the small caliber munitions, the second opening being between the heated detonation chamber and the first cooling chamber.

7. The apparatus of claim 6 wherein the tray runners extend through and are adapted for slidably receiving the tray through the second opening from the heated detonation chamber.

8. The apparatus of claim 6 further comprising a second cooling chamber at least partially defined by containment walls and sharing a wall with the first cooling chamber containment walls.

9. The apparatus of claim 8 wherein the wall between the second cooling chamber and the first cooling chamber containment comprises a partial wall.

10. The apparatus of claim 8 wherein the wall between the second cooling chamber and the first cooling chamber containment comprises a baffle.

11. The apparatus of claim 7 wherein the tray tracks extend through and are adapted for slidably passing the tray through the first and second cooling chambers.

12. The apparatus of claim 7 wherein the tray tracks extend through and are adapted for slidably passing the tray beyond the first and second cooling chambers.

13. The apparatus of claim 1 where the heat source comprises a hydrocarbon fired burner.

14. The apparatus of claim 1 further comprising a source of gaseous hydrocarbon.

15. The apparatus of claim 1 wherein the heated detonation chamber containment walls further include a gaseous products outlet.

16. The apparatus of claim 15 further comprising a scrubber in open communication with the gaseous products outlet for removing deleterious gaseous components produced as a result of the detonation of the small caliber munitions.

17. The apparatus of claim 1 wherein the first cooling chamber containment walls further include a gaseous products outlet.

18. The apparatus of claim 1 further comprising a scrubber in open communication with the gaseous products outlet for removing deleterious gaseous components produced as a result of the detonation of the small caliber munitions.

19. The apparatus of claim 6 further comprising a plurality of trays.

20. The apparatus of claim 9 further comprising a plurality of trays.

21. The apparatus of claim 11 further comprising a plurality of trays.

* * * * *